United States Patent [19]

Reppel

[11] Patent Number: 4,856,671

[45] Date of Patent: Aug. 15, 1989

[54] SELF-SUPPORTING STORAGE CONTAINER

[76] Inventor: Paul Reppel, Olmuhlerweg 5, 5883 Kierspe 3-Ronsahl, Fed. Rep. of Germany

[21] Appl. No.: 142,635

[22] Filed: Jan. 11, 1988

[30] Foreign Application Priority Data

Jan. 17, 1987 [DE] Fed. Rep. of Germany ..... 3701316

[51] Int. Cl.[4] ..... B65D 13/00

[52] U.S. Cl. ..... 220/4 F; 220/23.4; 220/23.83; 220/22.3; 211/194

[58] Field of Search ..... 220/4 F, 22, 22.1, 22.2, 220/22.3, 23.2, 23.4, 23.83; 206/504; 211/194

[56] References Cited

U.S. PATENT DOCUMENTS

| | | | |
|---|---|---|---|
| 2,297,859 | 10/1942 | Anderson | 220/23.83 |
| 2,942,749 | 6/1960 | Rosenberg | 220/4 F |
| 3,081,897 | 3/1963 | Livingston et al. | 220/4 F |
| 3,599,828 | 8/1971 | Conway | 220/23.4 |
| 3,672,531 | 6/1972 | Baluen | 220/4 F |
| 3,982,650 | 9/1976 | Ichihara | 220/4 F |
| 4,592,601 | 6/1986 | Hlinsky et al. | 206/504 X |

FOREIGN PATENT DOCUMENTS

| | | | |
|---|---|---|---|
| 1180303 | 10/1964 | Fed. Rep. of Germany | 220/4 F |
| 2312293 | 12/1973 | Fed. Rep. of Germany . | |
| 2344874 | 3/1975 | Fed. Rep. of Germany . | |
| 2312293 | 10/1976 | Fed. Rep. of Germany . | |
| 2003338 | 11/1969 | France | 220/4 F |
| 401908 | 5/1966 | Switzerland . | |
| 541730 | 3/1977 | U.S.S.R. | 220/4 F |
| 2088831 | 6/1982 | United Kingdom | 220/4 F |

*Primary Examiner*—Stephen Marcus
*Assistant Examiner*—Christine A. Peterson
*Attorney, Agent, or Firm*—Edwin D. Schindler

[57] ABSTRACT

The present invention provides a self-supporting storage container which includes a bottom wall which is provided with a series of slits. These slits are preferably provided in the region of the bottom wall near a free, unconnected edge, and parallel to such free edge, in a step offset downward by an amount equal to the thickness of the bottom wall. The invention further includes a support strip attached to the aforesaid step and insertion studs, the heights of which are equal to the height of the support strip. The insertion studs and detent tongues, on the enclosing wall or on a connecting edge of the bottom wall of a receptacle element, are capable of engagement as retaining members. Each receptacle element of the invention is made up of a rear wall, a bottom wall and a side wall and has retaining members at the free edges of the bottom wall and the rear wall which are opposite to the side wall. Each receptacle element also has retaining members at the connecting edges of the bottom wall and the rear wall, which are attached to the side wall, where the retaining members fit inside each other as pairs. An enclosing wall is also provided as part of the invention, which includes corresponding retaining members. The enclosing wall may also be used to sub-divide receptacle elements of the invention.

18 Claims, 2 Drawing Sheets

SELF-SUPPORTING STORAGE CONTAINER

BACKGROUND OF THE INVENTION

1. Technical Field of the Invention

The present invention relates, generally, to a self-supporting storage container. More particularly, the present invention relates to a self-supporting storage container for use as a structural assembly which includes a receptacle element, having a rear wall, bottom wall and a side wall, and a closure element. The closure element includes retaining members which are capable of fitting inside of one another in pairs. Such retaining members are provided at the free edges of the bottom wall and rear wall of the invention, which are opposite a side wall, as well as at other, connecting edges of the bottom and rear walls, which are attached to the side wall. In addition, such retaining members are provided at an enclosing side wall.

2. Description of the Prior Art

The prior art includes a self-supporting container, as disclosed in German Auslegeschrift 23 12 293, which is constructed as a receptacle element with a bottom wall, a rear wall and two side walls opposite each other. When these self-supporting storage containers of the prior art are placed against each other, two side walls of adjoining self-supporting storage containers are always adjacent to each other. A separate dividing wall is also provided for such self-supporting storage containers, which makes it possible to subdivide the self-supporting storage container into individual compartments. The cost of the materials for the construction of such a self-supporting storage container is comparatively high. Furthermore, adjacent self-supporting storage containers stand unattached to each other so that the arrangement of these self-supporting storage containers can be easily disturbed.

German Offenlegungsschrift 23 44 874 discloses a self-supporting container made up of two halves which can be attached to one another. The device disclosed in this reference includes several self-supporting storage containers made up of two such halves which, in addition, can be arranged adjacent to each other.

An additional self-supporting storage container, as generally being disclosed by the cited prior art, is described in Swiss Patent No. 401 908. In the container of this reference, the receptacle elements are inserted into each other from above so that each receptacle element must necessarily have three vertical walls in order to assure structural integrity. The adjacent receptacle elements do not have a common supporting surface so that the arrangement cannot be set on a base plate, on the bottom of a compartment in a cabinet, or in a similar area.

SUMMARY OF THE INVENTION

Accordingly, it is an object of the present invention to provide a self-supporting storage container that is versatile in terms of possible uses and modifications depending upon what a user wishes to store.

It is a further object of the present invention to provide a self-supporting storage container wherein the construction of the retaining members are such that the individual receptacle elements of the container have an exact seating and the enclosing wall is, furthermore, capable of use as a dividing wall.

It is an additional object of the invention to provide a self-supporting storage container which is economical to manufacture.

It is a yet further object of the present invention to provide a self-supporting storage container which overcomes the disadvantages inherent in prior art devices.

The foregoing and related objects are achieved in accordance with the present invention wherein the storage container of the invention includes a bottom wall which is provided with a series of slits. These slits are preferably provided in the region of the bottom wall near a free, unconnected edge, and parallel to such free edge, in a step offset downward by an amount equal to the thickness of the bottom wall. The invention further includes a support strip attached to the aforesaid step and insertion studs, the heights of which are equal to the height of the support strip. The insertion studs and detent tongues, on the enclosing wall or on a connecting edge of the bottom wall of a receptacle element, are capable of engagement as retaining members. The insertion studs each have heads, the width of which correspond to the length of a slit. The insertion studs of the enclosing side walls have a widened root, with each root standing on said step. Each receptacle element of the invention is made up of a rear wall, a bottom wall and a side wall and has retaining members at the free edges of the bottom wall and the rear wall which are opposite to the side wall. Each receptacle element also has retaining members at the connecting edges of the bottom wall and the rear wall, which are attached to the side wall, where the retaining members fit inside each other as pairs. An enclosing wall is also provided as part of the invention, which includes corresponding retaining members.

The claimed invention differs from state of the art devices inasmuch as each receptacle element of the device has only one rear wall and one side wall. The insertion studs are not latched in the bottom wall so that it is possible so that it is possible to make insertions vertically from above, i.e., parallel to the edge of the rear wall. The roots of the insertion studs can be widened at one or at both sides. The insertion studs are engagable in the slits of the step and are seated on the bearing surface so that each receptacle element has a secure seating. Owing to the special construction of the insertion studs on the enclosing side walls, it is possible to insert not only the enclosing side walls, but also the insertion studs on the connecting edge of a receptacle element, which is adjacent to a side wall, into the slits in the step. The front edges of the support strip and the insertion studs end in a common plane so that a receptacle element can be positioned with all side edges on a flat supporting surface.

For the shape-locking mutual retention of adjoining receptacle elements, or of an enclosing side wall, there are provided as retaining members, on the one hand, L-shaped slits at the free end of the rear wall, one arm of which runs parallel to the free edge, and, on the other hand, hooks bent over in a horizontal plane, on the enclosing side wall or on the connecting edge of the rear wall of a receptacle element, engagable in said slits.

In order that the rear walls of the self-supporting storage container join securely with each other, a step is provided at the free end of the rear wall in which the L-shaped slits are arranged.

A slight nesting of adjacent receptacle elements is assured by having the width of the bent arm of each L-shaped slit being parallel to the width of a hook.

A partitioning of the self-supporting storage container of the present invention into several compartments is possible since one or more rows of slits may be provided in the bottom wall and the rear wall, parallel to the row of slits located at the edge of the bottom wall, with the length of these slits corresponding to the width of the root of the insertion stud of the enclosing side wall.

Support of the enclosing side wall, as well as the dividing wall, on the rear wall is assured by providing a depression having approximately the thickness of the rear wall in the upper edge of the rear wall and by having a matching projection on the enclosing wall at the upper end of the rear edge.

The latching of the detent tongues is assured, in every case, by the fact that the detent tongues have a detent stud which is directed away from the free edge. This stud is capable of engagement under the bottom wall.

the careful insertion of the detent tongues is assured by the fact that the slits provided in the bottom wall, which are intended to receive the detent tongues, are widened in the direction of the free edge.

The self-supporting storage container of the present invention may also be hanged up inasmuch as supporting hooks, having a U-shaped bracket and a stud on an elongated arm of the bracket, may be provided which overlap the upper edge of the rear wall of the container and engage, by means of the stud, a hole in the rear wall. Many differing embodiments of supporting hooks, for use with the present invention, are possible and are intended to be within the scope of the invention.

The present invention will now be described in greater detail with reference being made to the accompanying drawing figures. It should, however, be recognized that the drawing is intended to be merely illustrative of an embodiment of the present invention and is not intended as a definition of the scope and limitations of the present invention.

BRIEF DESCRIPTION OF THE DRAWING

In the drawing, wherein similar reference characters denote similar features throughout the several views.

DETAILED DESCRIPTION OF THE DRAWING

Figures 1, 2, 3:
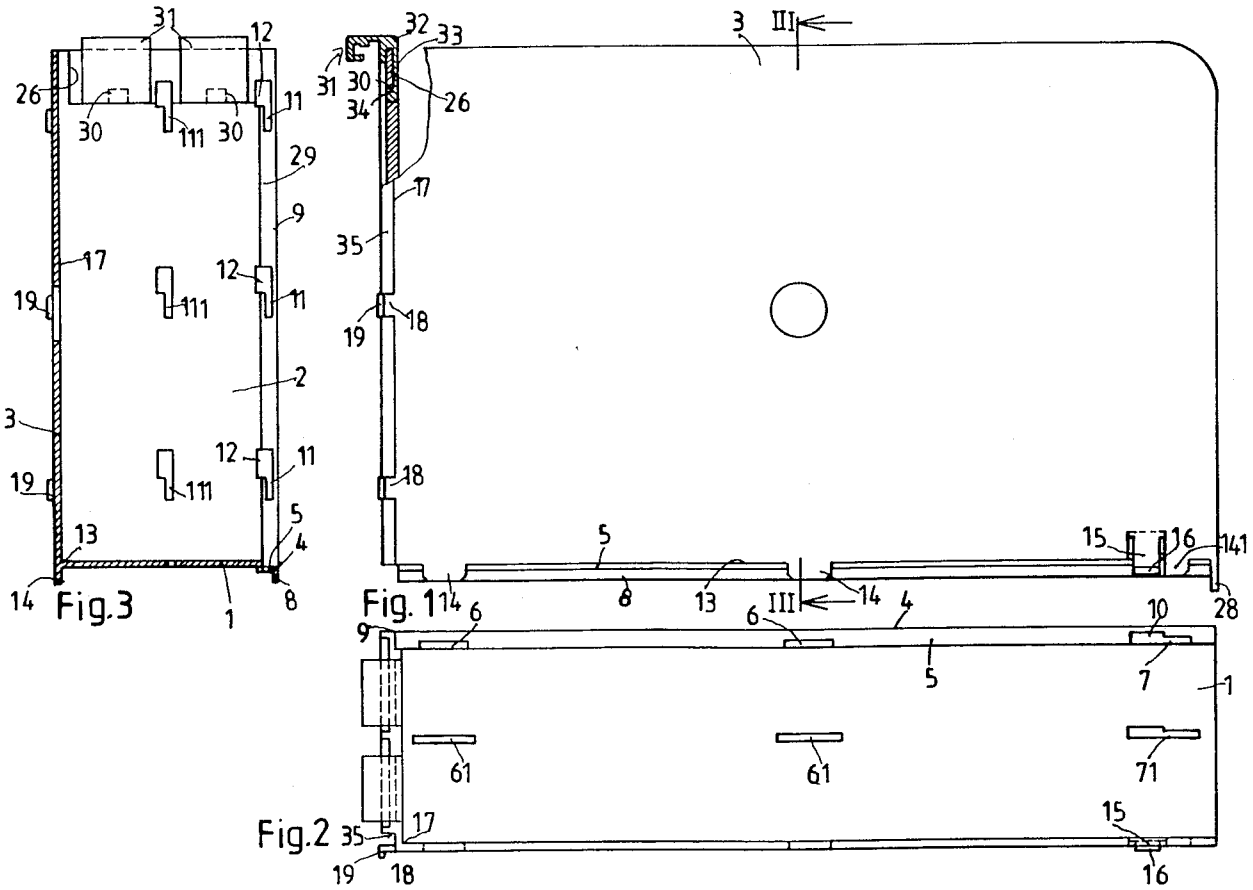
FIG. 1 illustrates a side view of a receptacle element of the present invention.
FIG. 2 illustrates a plan view of a receptacle element of the invention.
FIG. 3 illustrates a front view of the receptacle element of the invention, sectioned along line III in FIG. 1.

Turning now, in detail, to the drawing figures, the invention is shown as providing for a receptacle element made up of a bottom wall 1, a rear wall 2 and a side wall 3. The walls are connected to each other along common edges and, thus, form an angular receptacle element. Bottom wall 1 has a step 5 at its free edge 4, which overlaps side wall 3. This step is offset downward by an amount equal to the thickness of the bottom wall. In the embodiment illustrated, three slits, referred to by the numerals 6 or 7, are built into step 5, of which the slits designated by numeral 6, have the same shape. A support strip 8 is attached to step 5; it extends forward from bottom wall 1 and stands upright when the self-supporting storage container is placed on a supporting surface. Slit 7 has a widening 10, the function and purpose of which will be explained in greater detail hereinafter. At the side of bottom wall 1, opposite rear wall 2, there is an attaching flange 28, which projects downward opposite the support strip and permits the front edge of the bottom of a compartment to be attached. The attaching flange can also be fastened securely to the supporting surface.

With particular reference being made to FIG. 3, it may be seen that L-shaped slits 11 are constructed at a free edge 9 of rear wall 2 in a step 29, which is offset by an amount equal to the thickness of rear wall 2. One arm of each slit runs parallel to the free edge 9, and at the other side, it includes an arm 12, which is bent away and extends in a horizontal direction. A depression is formed in the upper part of rear wall 2 which has the same depth as step 29. In addition, two holes 30 are also provided.

Insertion studs 14 and detent tongues 15 are formed in the connecting edge 13 of bottom wall 1, which is attached to the side wall. Here, two insertion studs 14 having the same shape and one insertion stud 141, of a modified shape, as well as a single detent tongue 15, are represented. By means of appropriate cutouts, detent tongue 15 can be moved transversely to the plane of side wall 3; it has a detent stud which is directed away from side wall 3. Detent tongue 15 corresponds with widening 10 of slit 7 so that detent tongue 15 can deflect flexibly within this widening 10. Detent stud 16 then engages beneath the surface of bottom wall 1. The length of insertion studs 14 and 141 is equal to the height of support strip 8, in order that the front faces of insertion studs 14 and 141 and support strips 8 provide a common mounting surface. In this fashion, a receptacle element can be mounted upon a flat surface.

Hooks 18 are formed in a recessed step 35 at the connecting edge 17 of the back wall which attaches to side wall 3. These hooks have arms 19, which are bent downward and have a width corresponding to the width of arm 12 of slit 11, so that a hook 18 can be inserted into arm 12 of slit 11. Hooks 18 can then be displaced, together with the receptacle element, parallel to edge 9 in a vertical direction, so that hooks 18 are latched within slits 11 and, in this way, hooks 18 hold adjacent receptacle elements firmly, as will be explained in further detail hereinafter.

A further row of slits, 61 and 71, is provided in the bottom wall, parallel to the free edge 4. L-shaped slits 111 in the rear wall correspond to this row of slits. One row of each type of slit is shown in the drawing. It will be obvious to those skilled in the art that additional rows of slits may be provided.

The construction of the receptacle element, as has been described in detail above, has an angular structure open on three sides.

Figure 6:
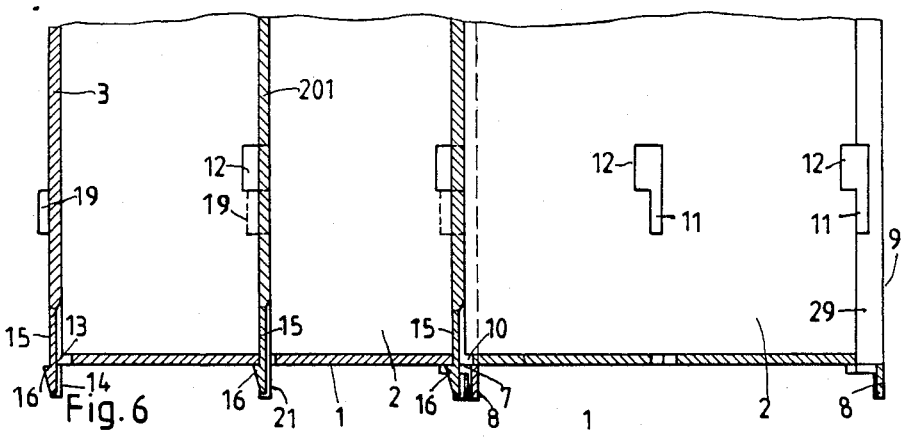
FIG. 6 illustrates an enlarged sectional view taken through the bottom portion of two receptacle elements arranged next to one another.
Figure 5:
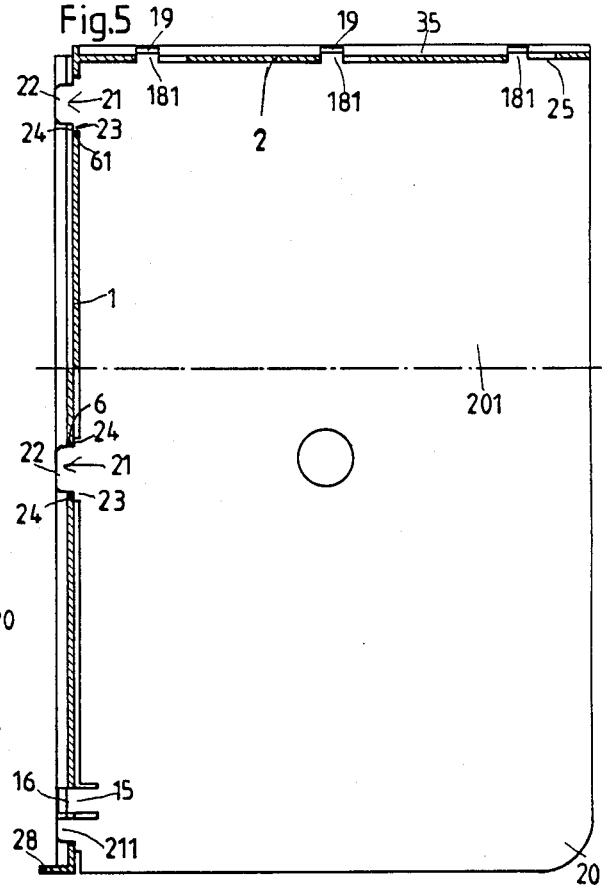
FIG. 5 illustrates a sectional view taken along the line V—V of FIG. 4.

An enclosing side wall 3 also forms part of the present invention, as is illustrated in detail in FIGS. 5 and 6. The enclosing side wall can also be utilized as a dividing wall, as will be further explained below. The enclosing side wall is an essentially flat plate, on whose lower edge are located insertion studs 21 and 211. These insertion studs each have a head 22, the width of which is equal to the length of a slit 6. The head sits on a widened root 23 with each root being offset in a step 24. The width of this root 23 is equal to the length of a slit 61. In addition, a detent tongue 15 is provided in the region of insertion stud 211, which is essentially of the same construction of the detent tongue 15 of the receptacle element and has therefore been similarly designated. It will be obvious to the skilled artisan that insertion tongue 211 is to have a step 24 of root 23, only on one side. Hooks 181 are located on the back edge of enclosing side wall 20; these correspond to hook 18 of a receptacle element. The enclosing side wall has, on its back edge in its upper part, a section 25, which projects forward. The projecting depth of section 25 corresponds to the depth of recess 26 in rear wall 2 of a receptacle element and, thus, to the thickness of the rear wall.

Figure 4:
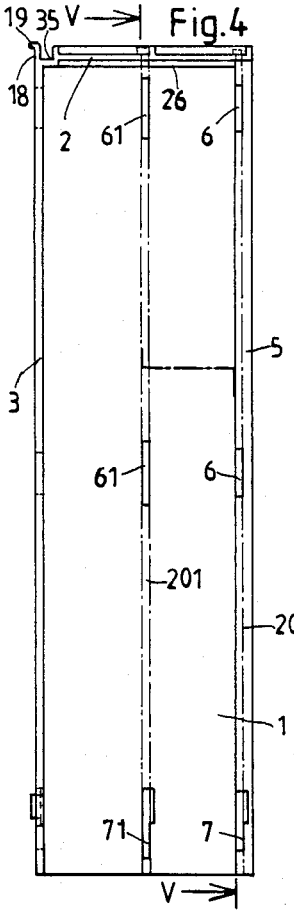
FIG. 4 illustrates a plan view of a receptacle element with an enclosing wall and a dividing wall, which are indicated by dot-dash lines.

In the plan view of FIG. 4, an enclosing wall 20 is sketched in schematically utilizing dot-dash lines, as an enclosing side wall 201 is used as a dividing wall. FIG. 5 shows, in a corresponding sectional view, in the upper half, the engagement of dividing wall 201, having insertion stud 21, into a slit 61. The width of root 23 corresponds to the length of slit 61 so that insertion stud 21 enters completely into slit 61 and the lower edge of dividing wall 201 stands on bottom wall 1. This construction insures that the front face of head 20 extends to the height of supporting strip 8 so that head 22 of dividing wall 201 stands on the mounting surface. The lower half of FIG. 5, corresponding to the section line, shows the engagement of insertion stud 21 into a slit 6 in step 5. The length of slit 6 corresponds to the width of head 22, so that only head 22 projects into slit 6 and step 24 of root 23 stands on step 5. This assures that head 22 is located at the height of the mounting surface. The function of detent tongue 15 is the same in both cases since, owing to the shape of slits 7 and 71, detent stud 16 of detent tongue 15 always engages under the bottom wall.

Additionally, a support hook 31 comprises a part of the present invention. Support hook 31 has a U-shaped racket 32 and a stud 34 on an elongated arm 33 of the bracket. The bracket overlaps the upper edge of rear wall 2 and, with its stud 34, it engages in hole 30 of the back wall. Support hook 31 may be hanged in a supporting frame. The precise shape of supporting hook 31 may be designed in various way, depending upon the requirements of the user.

The present invention thus makes it possible to construct a single, self-supporting storage container from a receptacle element and an enclosing side wall. This self-supporting storage container can be sub-divided into individual compartments by dividing walls, which are similar in construction to the enclosing side wall. A mounting surface is provided by supporting strip 8 and insertion studs 14. Attaching flange 28 permits alignment of the receptacle elements along one edge. The attaching flange can also be dispensed with if the receptacle element is intended to stand alone.

Any number of receptacle elements can be arranged alongside each other, as is illustrated in FIG. 6, on an enlarged scale. At each end of a series of receptacle elements, closure is effected by means of an enclosing side wall. Within the individual receptacle elements, any desired subdivisions can be provided by means of enclosing side wall used as dividing walls. In this way, any number of self-supporting storage containers can be constructed from a receptacle element and an enclosing side wall. Connection of the receptacle elements assures that each side wall of one receptacle element also forms the side wall of the adjoining receptacle element, so that one side wall can be saved. This thereby affords a considerable savings in materials necessary for construction. Furthermore, via the present invention, one is capable of achieving a structural integrity of the entire row of self-supporting storage containers. The entire row of self-supporting storage containers stands firmly on a support surface, since supporting strip 8 and the front faces of insertion studs 14 and 141 establish a common bearing surface.

The angular receptacle elements can be stacked inside each other in a space-saving manner for storage and shipment. Then, as per the requirements of the user, one enclosing wall is provided, e.g., for five receptacles elements. In this fashion, the receptacle elements permit a freely variable construction of self-supporting storage containers.

While only several embodiments of the present invention have been shown and described, it will be obvious to those skilled in the art that many modifications may be made to the present invention without departing from the scope and spirit thereof.

What is claimed is:

1. A self-supporting multiple storage container, comprising:

a plurality of receptacle elements wherein each receptacle element of said plurality of receptacle elements includes a bottom wall, said bottom wall having at least one free edge and at least one connecting edge, a rear wall having free edges and connecting edges, and a side wall so that adjacent receptacle elements stocked in a side-by-side manner would utilize a single side wall as a common wall, said bottom wall, said rear wall and said side wall being connected to one another along common edges to form each of said receptacle elements, said bottom wall having a step at said free edge which overlaps said side wall, said step being offset downward by an amount equal to the thickness of said bottom wall and having a series of slits, said series of slits being parallel to said free edge, each of said receptacle elements further including a closure element in which a series of retaining members, fitting one inside another in pairs, are provided at the free edges of said bottom wall and said rear wall, which are opposite said side wall, and at the connecting edges of said bottom wall and said rear wall which are attached to said side wall;

a support strip, said support strip being attached to said step;

a series of insertion studs being located in said side wall or in said connecting edge of said bottom wall; said insertion studs having a height that is substantially the same as the height of said support strip, said series of insertion studs and said support strip lying in a common plane with each of said series of insertion studs having a head which is supported on said step, the width of each of said heads corresponding to the length of one of said slits, with said insertion studs located in said side wall having a widened root; and, a series of detent tongues being located on said side wall or on said connecting edge of said bottom wall of said receptacle element which, in combination with said series of insertion studs, serve as said retaining members for engaging said side walls or said connecting edge of said bottom wall.

2. The self-supporting storage container according to claim 1, wherein said retaining members include a series of L-shaped slits and hooks, with each of said L-shaped slits having an arm running parallel to the free edge, in close proximity to the free edge, of said rear wall, and said hooks being bent over in a horizontal plane on said enclosing wall or at the connecting edge of said rear wall of said receptacle element, so that said hooks are capable of engaging said series of L-shaped slits.

3. The self-supporting storage container according to claim 2, wherein a second step is provided at the free edge of said rear wall in which said L-shaped slits are arranged.

4. the self-supporting storage container according to claim 2, wherein the width of said arm of each of said L-shaped slits is the same as the width of said hooks.

5. The self-supporting storage container according to claim 1, further comprising at least one additional row of slits located within said bottom wall and said rear wall, parallel to said series of slits located near said free edge of said bottom wall, where the lengths of said additional slits corresponding to the width of said root of said insertion stud of said enclosing side wall.

6. The self-supporting storage container according to claim 5, further comprising a depression, of approximately the thickness of said rear wall, which is provided at an upper edge of said rear wall with said enclosing wall having a corresponding projection at an upper end of a rear edge.

7. The self-supporting storage container according to claim 1, wherein said series of detent tongues include a detent stud which is directed away from the free edge of said bottom wall, said detent stud being capable of engagement under said bottom wall.

8. The self-supporting storage container according to claim 7, wherein said series of slits in said bottom wall, which are intended for engagement with said detent tongues, include at least one slit which has a widening in the direction of the free edge of said bottom wall.

9. The self-supporting storage container according to claim 1, further comprising at least one support hook, said support hook having a U-shaped bracket and a stud on an elongated arm of said bracket, with said support hook overlapping an upper edge of said rear wall and being capable of engaging said stud into a hole in said rear wall.

10. A self-supporting multiple storage container, comprising:

a plurality of receptacle elements wherein each receptacle element of said plurality of receptacle elements includes a bottom wall, said bottom wall having at least one free edge and at least one connecting edge, a rear wall having free edges and connecting edges, and a side wall so that adjacent receptacle elements stocked in a side-by-side manner would utilize a single side wall as a common wall, said bottom wall, said rear wall and said side wall being connected to one another along common edges to form said receptacle elements, said bottom wall having a step at said free edge which overlaps said side wall, said step being offset downward by an amount equal to the thickness of said bottom wall and having a series of slits, said series of slits being parallel to said free edge, each of said receptacle elements further including a closure element in which a series of retaining members are fitted inside one another in pairs, are provided at the free edges of said bottom wall and said rear wall, which are opposite said side wall, and at the connecting edges of said bottom wall and said rear wall which are attached to said side wall;

a support strip having a front edge, said support strip being attached to said step;

a series of insertion studs having a front edge and being located in said side wall or in said connecting edge of said bottom wall, said insertion studs having a height that is substantially the same as the height of said support strip, said series of insertion studs and said support strip lying in a common plane with each of said series of insertion studs having a head which is supported on said step, the width of each of said heads corresponding to the length of one of said slits, with said insertion studs located in said side wall having a widened root, and the front edges of said support strip and said insertion studs ending in a common plane so that said receptacle elements are positioned with all side edges on a flat supporting surface; and, a series of detent tongues being located on said side wall or on said connecting edge of said bottom wall of said receptacle elements which, in combination with said series of insertion studs, serve as said retaining members for engaging said side wall or said connecting edge of said bottom wall.

11. The self-supporting storage container according to claim 10, wherein said retaining members include a series of L-shaped slits and hooks, with each of said L-shaped slits having an arm running parallel to the free edge, in close proximity to the free edge, of said rear wall, and said hooks being bent over in a horizontal plane on said enclosing wall or at the connecting edge of said rear wall of said receptacle element, so that said hooks are capable of engaging said series of L-shaped slits.

12. The self-supporting storage container according to claim 11, wherein a second step is provided at the free edge of said rear wall in which said L-shaped slits are arranged.

13. The self-supporting storage container according to claim 11, wherein the width of said arm of each of said L-shaped slits is the same as the width of said hooks.

14. The self-supporting storage container according to claim 10, further comprising at least one additional row of slits located within said bottom wall and said rear wall, parallel to said series of slits located near said free edge of said bottom wall, where the lengths of said additional slits corresponding to the width of said root of said insertion stud of said enclosing side wall.

15. The self-supporting storage container according to claim 14, further comprising a depression, of approximately the thickness of said rear wall, which is provided at an upper edge of said rear wall with said enclosing wall having a corresponding projection at an upper end of a rear edge.

16. The self-supporting storage container according to claim 10, wherein said series of detent tongues include a detent stud which is directed away from the free edge of said bottom wall, said detent stud being capable of engagement under said bottom wall.

17. The self-supporting storage container according to claim 16, wherein said series of slits in said bottom wall, which are intended for engagement with said detent tongues, include at least one slit which has a widening in the direction of the free edge of said bottom wall.

18. The self-supporting storage container according to claim 10, further comprising at least one support hook, said support hook having a U-shaped bracket and a stud on an elongated arm of said bracket, with said support hook overlapping an upper edge of said rear wall and being capable of engaging said stud into a hole in said rear wall.

* * * * *